United States Patent [19]

Almqvist et al.

[11] Patent Number: 4,635,714

[45] Date of Patent: Jan. 13, 1987

[54] PACKING GROOVE IN PLATE MEMBER OF PLATE HEAT EXCHANGER

[75] Inventors: Christer Almqvist, Täby; Bengt Carlsson, Vargön; Lars Lindahl, Handen, all of Sweden

[73] Assignee: ReHeat AB, Täby, Sweden

[21] Appl. No.: 435,604

[22] Filed: Oct. 20, 1982

[30] Foreign Application Priority Data

Oct. 21, 1981 [SE] Sweden ..... 8106221

[51] Int. Cl.[4] ..... F28F 3/10

[52] U.S. Cl. ..... 165/167; 165/906

[58] Field of Search ..... 165/167, 166, 906

[56] References Cited

U.S. PATENT DOCUMENTS

| | | | |
|---|---|---|---|
| 2,075,236 | 3/1937 | Seligman et al. | 165/167 |
| 2,191,044 | 2/1940 | Seligman | 165/167 |
| 2,193,405 | 3/1940 | Goodman | 165/167 |
| 2,217,567 | 10/1940 | Seligman et al. | 165/167 |
| 2,621,028 | 12/1952 | Newhall | 165/167 |
| 2,865,613 | 12/1958 | Egenwall et al. | 165/167 |
| 3,450,200 | 6/1969 | Wright | 165/167 |
| 4,146,090 | 3/1979 | Nakayama et al. | 165/167 |

FOREIGN PATENT DOCUMENTS

| | | | |
|---|---|---|---|
| 0049892 | 5/1981 | Japan | 165/166 |
| 83/00736 | 3/1983 | PCT Int'l Appl. | 165/166 |
| 502819 | 3/1939 | United Kingdom | 165/166 |
| 0755876 | 8/1956 | United Kingdom | 165/166 |
| 2078926 | 1/1982 | United Kingdom | 165/166 |

*Primary Examiner*—William R. Cline
*Assistant Examiner*—John K. Ford
*Attorney, Agent, or Firm*—Cushman, Darby & Cushman

[57] ABSTRACT

The invention relates to a packing groove in a plate member for a heat exchanger, especially to a packing groove at the inlet and outlet portions of the plate member. The bottom of the packing groove includes according to the invention strengthening bars, which are embossed in the bottom of the packing groove and extend substantially along the groove.

7 Claims, 7 Drawing Figures

PACKING GROOVE IN PLATE MEMBER OF PLATE HEAT EXCHANGER

This invention relates to a new type of packing grooves in plate members of plate heat exchangers.

The plate members comprised in a plate heat exchanger show a waved pattern of elongated distance members forming the passageways for the media flowing through the heat exchanger. About the circumference of the plate members a groove, a packing groove, is punched out, which is intended to receive a packing. In mounted state of the heat exchanger the packings in the grooves are sealingly pressed between the plate members, which thereby are provided a fully satisfactory support against each other and between the end wall pieces.

All types of plate members, however, have in common the critical areas about the inlet and outlet portions of the plate members. In a plate package, namely, every second space between plates has a packing in said area while every second such space has no packing. This is necessary in order to effect the flow of the media in the plate package and for separating the inlet and outlet of the media from each other. The missing packing between every second plate member implies that the sheet metal material constituting the plate member all by itself must take up the entire packing pressure as well as the possible difference between the pressures, at which the medium in question operates.

This problem has heretofore been solved in that a great number of well-formed supporting point in the form of "warts" have been punched in the plates about the grooves. At another solution, in order to manage high difference pressures between the media, a separate strip of wave-shape, more precisely in the form of a square curve, is laid in the packing groove separating the inlet and outlet portions, which groove does not contain a packing. It is not possible by means of the "warts" to provide a support for the groove bottom proper, but only local spots of support to the side of the groove are obtained. At higher difference pressures, therefore, the groove is deformed and gives rise to leakage. The square-curve shaped strips certainly provide a support for the groove bottom proper, but imply a certain throttling due to the additive material forming the strip in the groove. This throttling easily will become unacceptable, because the channels formed by the strip have a tendency of clogging as the media involved often are not entirely clean. Moreover, the strip per se renders both the manufacturing and the mounting more expensive.

The present invention eliminates the aforesaid disadvantages by having been given the characterizing features defined in the attached claims. The invention provides a groove, which is self-bearing and capable to withstand high packing and difference pressures.

Figure 1:
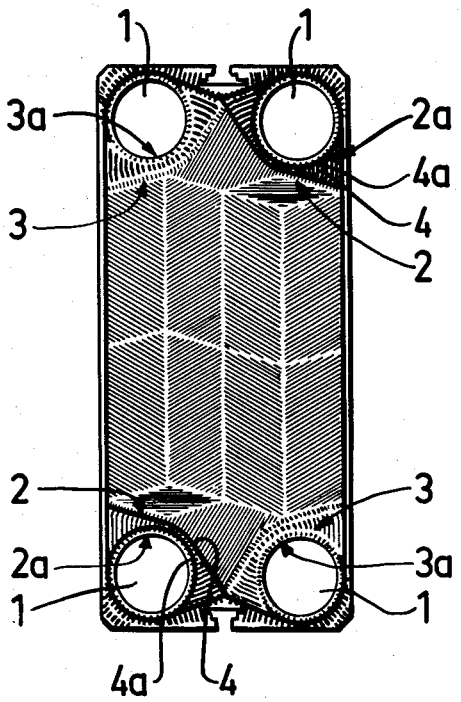
Figure 4:
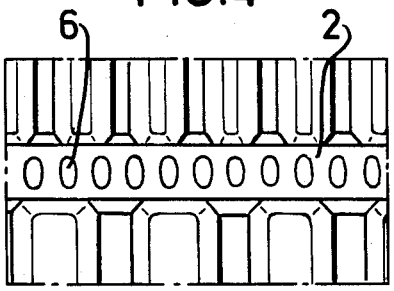
Figure 5:
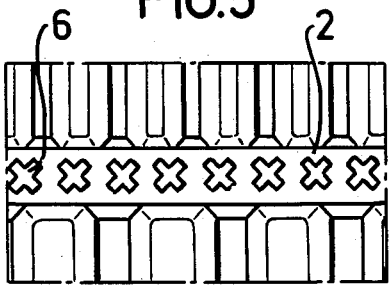
Figure 6:
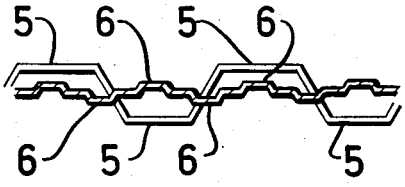
Figure 7:
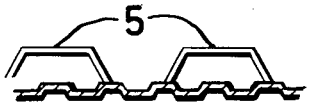

The invention is described in greater detail in the following by way of embodiments and with reference to the accompanying drawing, in which FIG. 1 shows a plate member of the type here concerned, FIGS. 2–5 are horizontal views of a number of embodiments of grooves according to the invention, and FIGS 6–7 are longitudinal sections of the respective grooves according to FIGS. 2–5.

The conventional plate member shown in FIG. 1 is intended to be comprised in a plate package. 1 designates the inlet and outlet ports of the plate member. The area surrounding the respective port is defined in usual manner from the remaining part of the plate member by grooves 2,*2a* and 3,*3a*. As shown in the Figure, two such grooves 2, *2a* in two of the areas are provided with packings 4, *4a*, while the two grooves 3,*3a* of the other areas have no such packings on this side of the plate member. A plate member "located above" the plate member shown has packings only in the grooves 3,*3a*. The next following member again has packings only in the grooves 2,*2a*, and so on. The grooves 2,*2a* and, respectively, 3,*3a*, thus, have no packing in every second space between the plate members. This in its turn means that, as mentioned above in the introductory part, the bottoms of the grooves 2,*2a*, 3,*3a* must take up the entire packing pressure and possibly the difference pressure between the working media. For being capable to manage this without the arrangement of complementary "warts" or separate waved strips, the grooves according to the invention have been given a special design.

Figure 2:
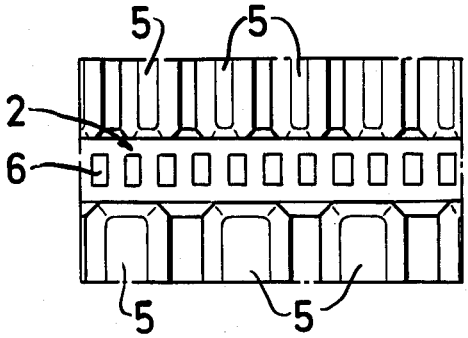
Figure 3:
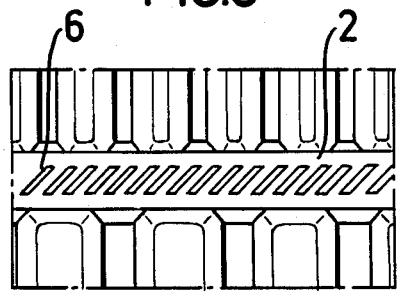

The groove, for example the groove 2, is shown in FIGS. 2 and 6 formed in the neutral plane of the plate member, i.e. substantially centrally between the tops of the depressions and elevations 5 forming the channels of the plate member. In the groove bottom, i.e. the material of the plate member, embossed rectangular bars or elevations 6, which do not break through the material, are provided in spaced relationship and directed alternatingly in opposed directions relative to the plane of the plate member. The respective elevation has a longitudinal extension perpendicular to the longitudinal direction of the groove. The length of the elevation, as appears from FIG. 2, is shorter than the width of the groove. Hereby, as the invention is shown and described, a geometrically conditioned stiffening of the groove bottoms is obtained at the same time as the material in the bottoms is cold hardened. Thereby the bottom material is more resistant to bending than the sheet metal material in the remaining part.

The invention, by the embodiment shown, has proved to meet very high requirements with respect to packing pressure and difference pressure and replaces entirely conventional methods and means for preventing deformation and leakage in connection to packing grooves at the inlet and outlet portions of plate heat exchangers.

The invention has been described above at such packing grooves, which are located in the central plane of the plate member. The invention, of course, is not restricted to this location of the groove bottom, but can without inconvenience also be applied to plate members, which are embossed with packing grooves, the bottoms of which are located in the same plane as the tops of the depressions or elevations on one side of the plate member. In this case, as shown in FIG. 7, the bars 6 are directed in the same direction, preferably to the central plane of the plate member.

It is not necessary that the bars 6 extend perpendicularly to the longitudinal direction of the groove. As appears from FIG. 3, they may for example be given a certain angle of inclination to the longitudinal direction. It is not necessary, either, that the bars have straight sides, but the sides may extend arc-shaped. The bars 6, for example, may have the form of long and narrow ellipses, as shown in FIG. 4. FIG. 5 shows another variant of the form of the bars 6. Two bars form here a cross with equal leg length, and the bars forming the cross are turned through 45° in relation to the longitudinal direction of the grooves 2.

The elevations or bars, of course, may within the scope of the invention have a form and cross-sectional profile other than those shown, depending on the loads and pressures intended. As an extreme, the bars may be formed of an embossing of sinus wave shape in the groove bottom, which, however, implies a lower degree of cold hardening of the material.

What we claim is:

1. A plate for a plate-type heat exchanger, said plate having a fluid inlet opening therethrough and a fluid outlet opening therethrough, said plate having alternate depressions and elevations in one face thereof which form respective elevations and depressions in the opposite surface of the plate, said elevations and depressions forming fluid flow channels on each surface of the plate, the tops of the elevations on each surface lying in a common plane, and said plate having at least one packing groove intersecting said elevations and depressions, said groove having a bottom located in a plane which is intermediate said common planes, said bottom having a plurality of longitudinally spaced apart bars embossed therein, said bars projecting perpendicularly to said intermediate plane with alternate bars projecting in opposite directions away from said intermediate plane so as to form alternate elevations and depressions in said bottom, the tops of the elevations in said bottom lying in essentially a common plane which is between said intermediate plane and the common plane defined by the tops of said channel-forming elevations.

2. A plate as in claim 1 wherein each embossed bar has a dimension extending crosswise of the respective groove, said crosswise dimension being less than the width of the groove.

3. A plate as in claim 1 wherein each embossed bar, in plan view, is rectangular.

4. A plate as in claim 1 wherein each embossed bar, in plan view, is oval.

5. A plate as in claim 1 wherein each embossed bar, in plan view, has the shape of a cross.

6. A plate as in claim 1 wherein each embossed bar has a long dimension and a short dimension, in plan view, and wherein the long dimension entends transversely to the longitudinal direction of the respective groove.

7. A plate as in claim 1 wherein each embossed bar has a long dimension and a short dimension, in plan view, and wherein the long dimension extends at an angle different from 90° to the longitudinal direction of the respective groove.

* * * * *